US007261609B2

(12) United States Patent
Hori

(10) Patent No.: US 7,261,609 B2
(45) Date of Patent: Aug. 28, 2007

(54) SPARK PLUG MANUFACTURING APPARATUS AND METHOD OF MANUFACTURING SPARK PLUG

(75) Inventor: Kouji Hori, Kuwana (JP)

(73) Assignee: Denso Corporation, Kariya, Aichi-pref (JP)

( * ) Notice: Subject to any disclaimer, the term of this patent is extended or adjusted under 35 U.S.C. 154(b) by 0 days.

(21) Appl. No.: 11/410,947

(22) Filed: Apr. 26, 2006

(65) Prior Publication Data

US 2006/0246807 A1 Nov. 2, 2006

(30) Foreign Application Priority Data

Apr. 28, 2005 (JP) ..... 2005-132213

(51) Int. Cl.
*H01T 21/02* (2006.01)

(52) U.S. Cl. ..... 445/7; 264/162; 264/614; 264/678

(58) Field of Classification Search ..... 445/7
See application file for complete search history.

(56) References Cited

FOREIGN PATENT DOCUMENTS

| | | |
|---|---|---|
| JP | 2004-319335 | 11/2004 |
| JP | 2005-132691 | 5/2005 |
| JP | 200513691 A2 * | 5/2005 |

* cited by examiner

*Primary Examiner*—David Bruce
*Assistant Examiner*—Conrad R. Blease
(74) *Attorney, Agent, or Firm*—Nixon & Vanderhye P.C.

(57) ABSTRACT

The spark plug manufacturing apparatus includes a holding plate formed with a plurality of mounting holes penetrating from a front surface to a rear surface thereof for holding therein hollow tubular insulators of spark plugs, each of which is fitted therein with a center electrode and a metal stem provided with a terminal part, and is charged with a powder resistance material between the center electrode and the stem, and an electric furnace for heating the insulators held in the mounting holes of the holding plate. The holding plate is made of a ceramic material containing not less than 50 wt % of silicon nitride.

9 Claims, 7 Drawing Sheets

FIG. 8
| | HEAT-RESISTING STEEL | | SILICON NITRIDE | | ALUMINA | | SILICON CARBIDE | |
|---|---|---|---|---|---|---|---|---|
| SPECIFIC GRAVITY ($g/cm^3$) | 8.0 | × | 3.2 | ◎ | 3.7 | ○ | 3.1 | ◎ |
| SPECIFIC HEAT ($J/cm^3 \cdot K$) | 4.0 | △ | 2.2 | ◎ | 3.0 | ○ | 2.1 | ◎ |
| HOT BENDING STRENGTH at 800℃ (MPa) | 196 | △ | 800 | ◎ | 300 | △ | 350 | △ |
| THERMAL SHOCK TEMPERATURE (℃) | >900 | ◎ | 850 | ◎ | 250 | × | 350 | × |
| THERMAL CONDUCTIVITY (W/m·K) | 16 | △ | 25～65 | ◎ | 24 | △ | 75 | ◎ |
| LIFE (YEARS) | 2 | △ | >10 | ◎ | 0 | × | 0 | × |
FIG. 9A
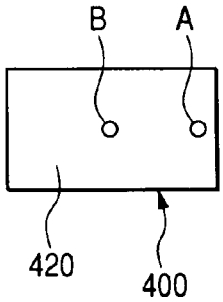
FIG. 9B
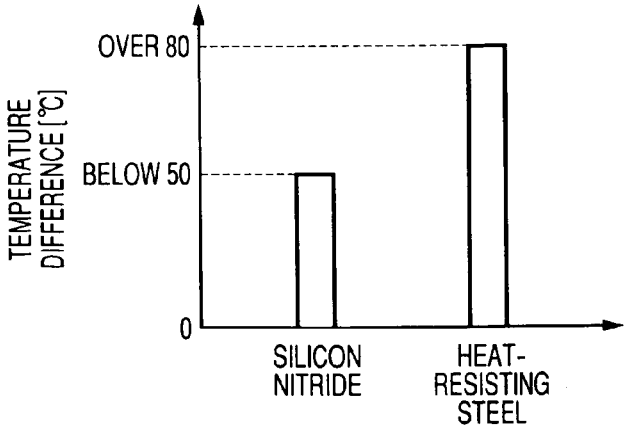

SPARK PLUG MANUFACTURING APPARATUS AND METHOD OF MANUFACTURING SPARK PLUG

CROSS-REFERENCE TO RELATED APPLICATION

This application is related to Japanese Patent Application No. 2005-132213 filed on Apr. 28, 2005, the contents of which are hereby incorporated by reference.

BACKGROUND OF THE INVENTION

1. Field of the Invention

The present invention relates to a spark plug manufacturing apparatus provided with a holding plate (pallet) for holding insulators for spark plugs during a heating process for manufacturing the spark plugs, and to a method of manufacturing spark plugs by use of the holding plate.

2. Description of Related Art

Generally, a spark plug for an internal combustion engine includes a tubular mounting fitting having a threaded portion for installation to the engine, an insulator fixed to the inside of the mounting fitting such that the front end thereof projects from the front end of the mounting fitting, a center electrode fitted into an axial hole of the insulator such that the front end thereof projects from the front end of the insulator, and a ground electrode fixed to the mounting fitting so as to face the front end of the center electrode across from a spark discharge gap.

First and second glass seal layers for providing the axial hole of the insulator with air tightness, and a resistor glass are provided in the axial hole. The rear end of the center electrode is electrically connected to the resistor glass through the first glass seal layer. The resistor glass is electrically connected to one end of a metal stem through the second glass seal layer at the side of the rear end of the insulator within the axial hole. A terminal part which exposes at the surface of the rear end of the insulator is connected to the other end of the stem. This terminal part is fitted with a boots part of an ignition coil.

Next, explanation is made as to how the first and second glass seal layers, and the resistor glass are formed in the axial hole of the insulator (for detail, refer to Japanese Patent Application Laid-open No. 2004-319335, for example).

At the beginning, the center electrode is fitted into the hollow portion (axial hole) of the hollow tubular insulator. After that, a powder material of a conductive glass is charged into the hollow portion and pressurized to make the first glass seal layer in a first glass material charging process.

Subsequently, a resistor material of the resistor glass is charged into the hollow portion and pressurized on the powder material charged in the first glass material charging process. Next, a powder material of a conductive glass is charged into the hollow portion and pressurized by the stem to make the second glass seal layer in a second glass material charging process.

After that, a plurality of the insulators each of which has undergone the above described processes are loaded on a pallet which is made of a heat-resisting steel and exhibits resistance to thermal shock applied in a heating process where quick heat-up and rapid cool-down are repeated. This pallet has a plurality of mounting holes to which the insulators are fitted so that they can be heated at once in order to increase the productivity of the spark plugs.

In a subsequent heating process, the pallet is carried into an electric furnace where the insulators loaded on the pallet are heated for a certain time at a certain temperature, for example, at 900 degrees C. FIG. 10 shows the insulators 20 loaded on the pallet 500 carried into the electric furnace. In this heating process, the pallet 500 slides over a hearth 600 to move in the electric furnace while being heated by an upper electric heater 710 facing the top surface of the pallet 500 and a lower electric heater 720 facing the rear surface of the pallet 500. Inconsequence, the insulators 20 are heated and the first and second glass seal layers of each insulator 20 are put in a molten state.

After completion of the heating process, the pallet 500 is carried out from the electric furnace, and the terminal parts 71 are pressed down into the interiors of the insulators 20. After that, the insulators 20 are cooled down rapidly, as a result of which the first and second glass seal layers and the resistor glass of each insulator 20 are solidified. In this way, the first and second glass seal layers and the resistor glass are formed in the insulator 20.

However, the inventor has found that the pallet 500 used in the heating process has technical challenges to be resolved, which are set forth below.

First, the pallet 500, which is capable of loading a plurality of works (insulators 20) thereon to increase the productivity, is heavy in weight, because it is made of the heat-resisting steel. Accordingly, prior to heating the works to 900 degrees C., the pallet 500 has to be heated. However, because of the heavy weight of the heat-resisting steel (more than 4 kg/50 pieces of works (mounting holes), for example), heating the pallet takes a long time and a large amount of energy.

Secondly, since the pallet 500 is subjected to cycles of quick heating up and rapid cooling down during the heating process, the pallet 500 is oxidized, and is deformed due to thermal expansion. Accordingly, the life span of the pallet 500 is as short as from one year and a half to two years.

Thirdly, at the time of pressing down the terminal part 71, the terminal part 71 may be off the center of the axis of the insulator 20 due to deformation of the pallet 500. If the offset value is too large, there is a possibility that the insulator 20 is broken.

Fourthly, it takes a long time for the temperature of the pallet 500 to become uniform since the pallet 500 is made of the heat-resisting steel having a low thermal conductivity. In addition, when the pallet 500 is heated at a plurality of different positions thereof independently, there arises position-related temperature difference. The inventor has found through experiment that the interior temperature difference between the insulator 20 located at the edge portion of the pallet 500 and the insulator 20 located at the center portion of the pallet 500 is more than 80 degrees C./50 pieces. Such a large temperature difference causes the resistor glasses of the insulators 20 to have different resistances even though they have been loaded on the same pallet and subjected to the same heating process.

SUMMARY OF THE INVENTION

The present invention provides a spark plug manufacturing apparatus including:

a holding plate formed with a plurality of mounting holes penetrating from a front surface to a rear surface thereof for holding therein hollow tubular insulators of spark plugs, each of which is fitted therein with a center electrode and a metal stem provided with a terminal part, and is charged with a powder resistance material between the center electrode and the stem; and an electric furnace for heating the insulators held in the mounting holes of the holding plate;

wherein the holding plate is made of a ceramic material containing not less than 50 wt % of silicon nitride.

The holding plate preferably has such a thickness that one end of the center electrode and one end of the stem of the insulator held in the mounting hole projects from the rear surface and the front surface of the pallet, respectively, and has a bending strength not less than 600 MPa when heated to 800 degrees C.

The holding plate preferably has a thermal conductivity not less than 30 W/m·K. The mounting holes may be arranged in a staggered fashion.

The present invention also provides a method of manufacturing spark plugs including the steps of:

fitting a center electrode and a metal stem provided with a terminal part into a hollow portion of each of a plurality of hollow tubular insulator in a state that a powder resistance material is charged between the center electrode and the stem;

loading the plurality of the insulators fitted with the center electrode and the stem and charged with the powder resistance material on a holding plate in such a state that the insulators are held in mounting holes formed in the holding plate; and heating the insulators loaded on the holding plate in an electric furnace;

wherein the holding plate is made of a ceramic material containing not less than 50 wt % of silicon nitride.

The method may further include the steps of fitting a housing to each of the plurality of insulators which have undergone the heating step, and joining a ground electrode to the housing such that the ground electrode faces an end of the center electrode to form a spark gap.

According to the present invention, it is possible to reduce the costs and the amount of energy needed to manufacture the spark plugs, because the holding plate (pallet) is made of a ceramic material containing not less than 50 wt % of silicon nitride, which exhibits excellent physical properties in terms of the specific gravity, specific heat, hot bending strength, thermal shock temperature, thermal conductivity, and life.

According to the present invention, it is also possible to reduce the variation of resistances of resistors formed in the insulators, because the pallet made of the ceramic material containing not less than 50 wt % of silicon nitride has a high thermal conductivity, and therefore it exhibits a small temperature nonuniformity when heated.

BRIEF DESCRIPTION OF THE DRAWINGS

In the accompanying drawings:

FIG. 8 is a table showing various physical properties of the pallets made of silicon nitride, heat-resisting steel, alumina, and silicon carbide;

FIG. 9A is a diagram showing different two positions of the insulators loaded on the pallet, whose temperatures should be measured;

FIG. 9B is a graph showing temperature difference between the two insulators for the pallet made of silicon nitride, and for the pallet made of heat-resisting steel.

PREFERRED EMBODIMENTS OF THE INVENTION

Figure 1:
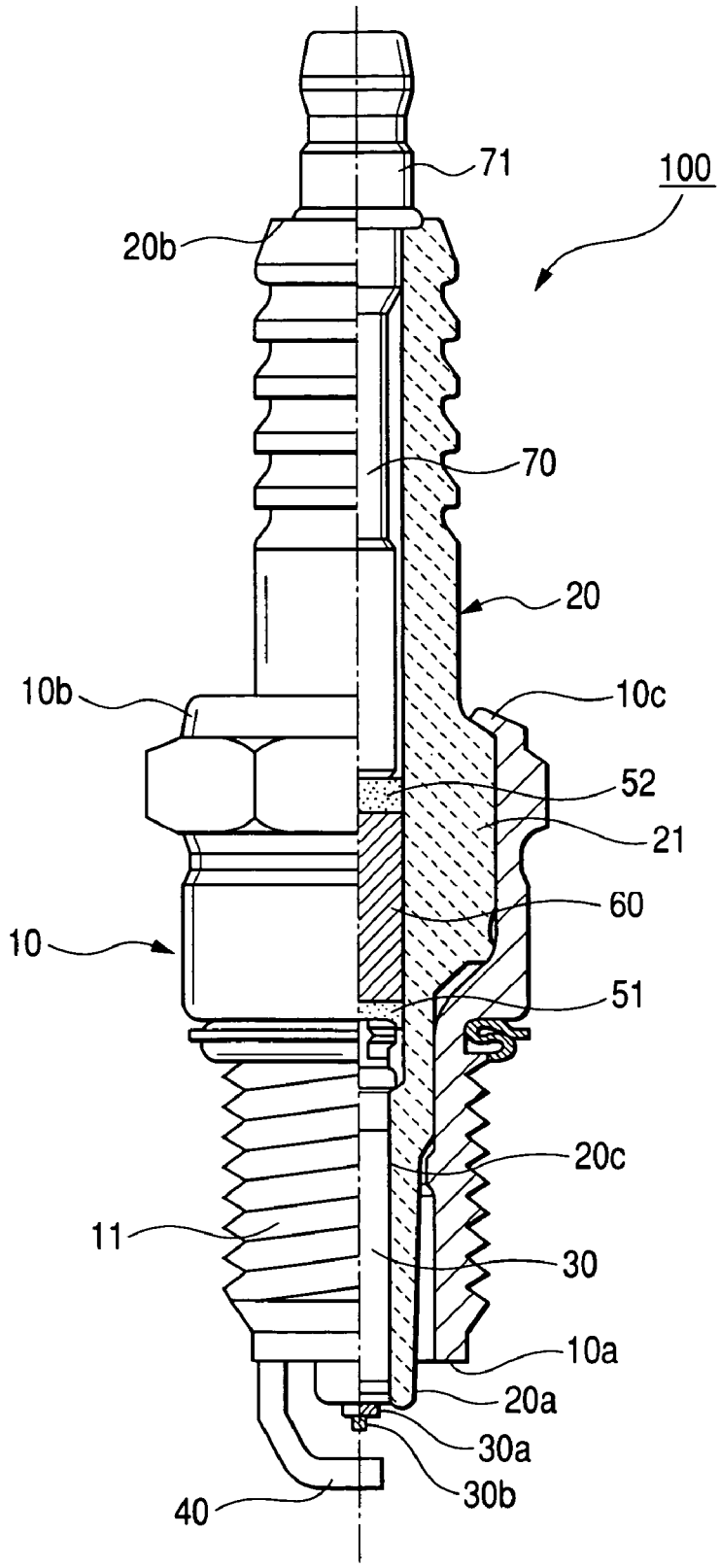
FIG. 1 is a half cross-sectional view of a spark plug manufactured by a method according to an embodiment of the invention.
Figure 10:
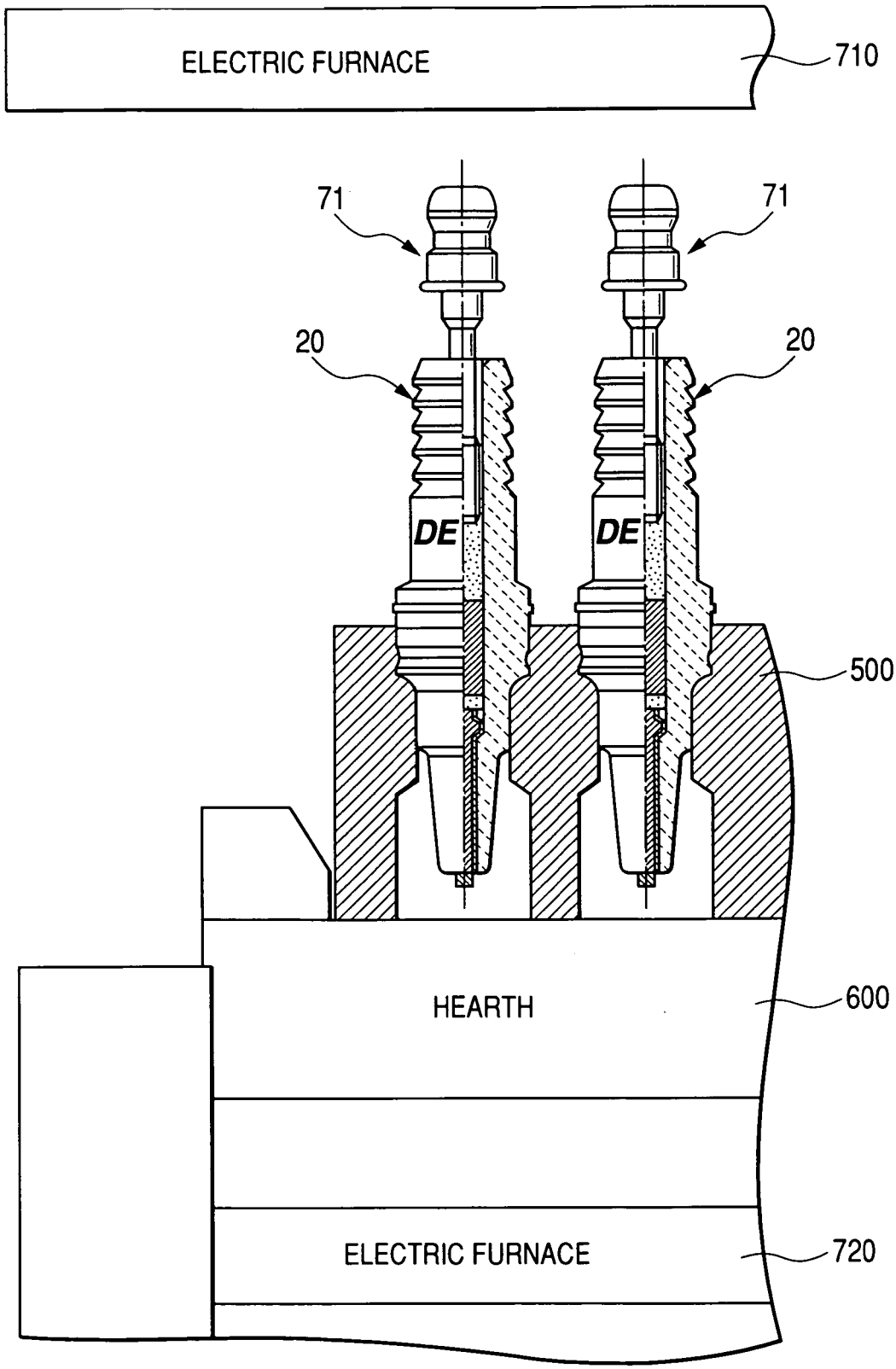
FIG. 10 is a diagram showing a conventional pallet on which insulators are loaded to be heated in an electric furnace.

FIG. 1 is a half cross sectional view of a spark plug 100 manufactured by a spark plug manufacturing apparatus according to an embodiment of the invention. In FIG. 1, the reference characters identical to those in FIG. 10 represent the same elements. The spark plug 100, which can be used for a vehicle engine, is configured to be inserted into a screw hole formed in an engine head (not shown) of the vehicle engine.

As seen from FIG. 1, the spark plug 100 includes a tubular housing 10 made of a conductive steel material (low-carbon steel, for example). The housing 10 has a mounting screw 11 at its circumference for fixation to an engine block (not shown).

The housing 10 houses an insulator 20 made of an electrically insulating material such as alumina ceramic ($Al_2O_3$) in such a way that the front end 20*a* of the insulator 20 projects from the front end 10*a* of the housing 10, and the rear end 20*b* of the insulator 20 projects from the rear end 10*b* of the housing 10. A center electrode 30 is fitted into an axial hole 20*c* of the insulator 20. The center electrode 30 is held by the insulator 20 in an insulated state with respect to the housing 10.

As shown in FIG. 1, the insulator 20 has a barrel portion 21 having the largest diameter of all the positions of the insulator 20 housed in the housing 10.

The center electrode 30 having a cylindrical shape is constituted by an inner member made of a metal material having a good thermal conductivity such as Cu, and an outer member made of a metal material having good heat resistively and good corrosion resistively such as Ni-based alloy. A cylindrical precious metal chip is joined, as a spark discharge member, to the front end 30*a* of the center electrode 30 by laser welding or resistance welding.

A ground electrode 40 is joined to the front end of the housing 10. The ground electrode 40, which is made of a Ni-based alloy consisting chiefly of Ni, is welded to the housing 10 at one end thereof, and is bent by about 90 degrees to form a gap with the front end of the center electrode 30 at the other end thereof.

There are provided a first glass seal layer 51, a resistor 60, a second glass seal layer 52, and a metal stem 70 fitted with a terminal part 71 at the side of the rear end of the center electrode 30 which is fitted into the axial hole 20*c* of the insulator 20.

The resistor 60, which is a resistive element having a certain resistance, is formed by sintering powdered resistive material constricting chiefly of glass mixed with carbon powder. The first and second glass seal layers 51, 52 are respectively disposed at the both longitudinal ends of the resistor 60 in order to prevent the side of the center electrode 30 (the inside of a combustion chamber) and the side of the terminal part 71 (the outside of the combustion chamber) from communicating with each other.

The resistor 60 is electrically connected to one end of the cylindrical stem 70 through the second glass seal layer 52. The terminal part 71 provided at the other end of the stem 70 exposes at the surface of the rear end 20*b* of the insulator 20. This terminal part 71 is fitted with a boots part of an ignition coil (not shown).

The insulator 20 is crimped to a crimp portion 10*c* formed in the rear end 10*b* of the housing 10. The spark plug 100 having the above described structure ignites gaseous fuel by making a spark between the center electrode 30 and the ground electrode 40.

Next, explanation is made for an apparatus for manufacturing the spark plug 100.

Figure 2:
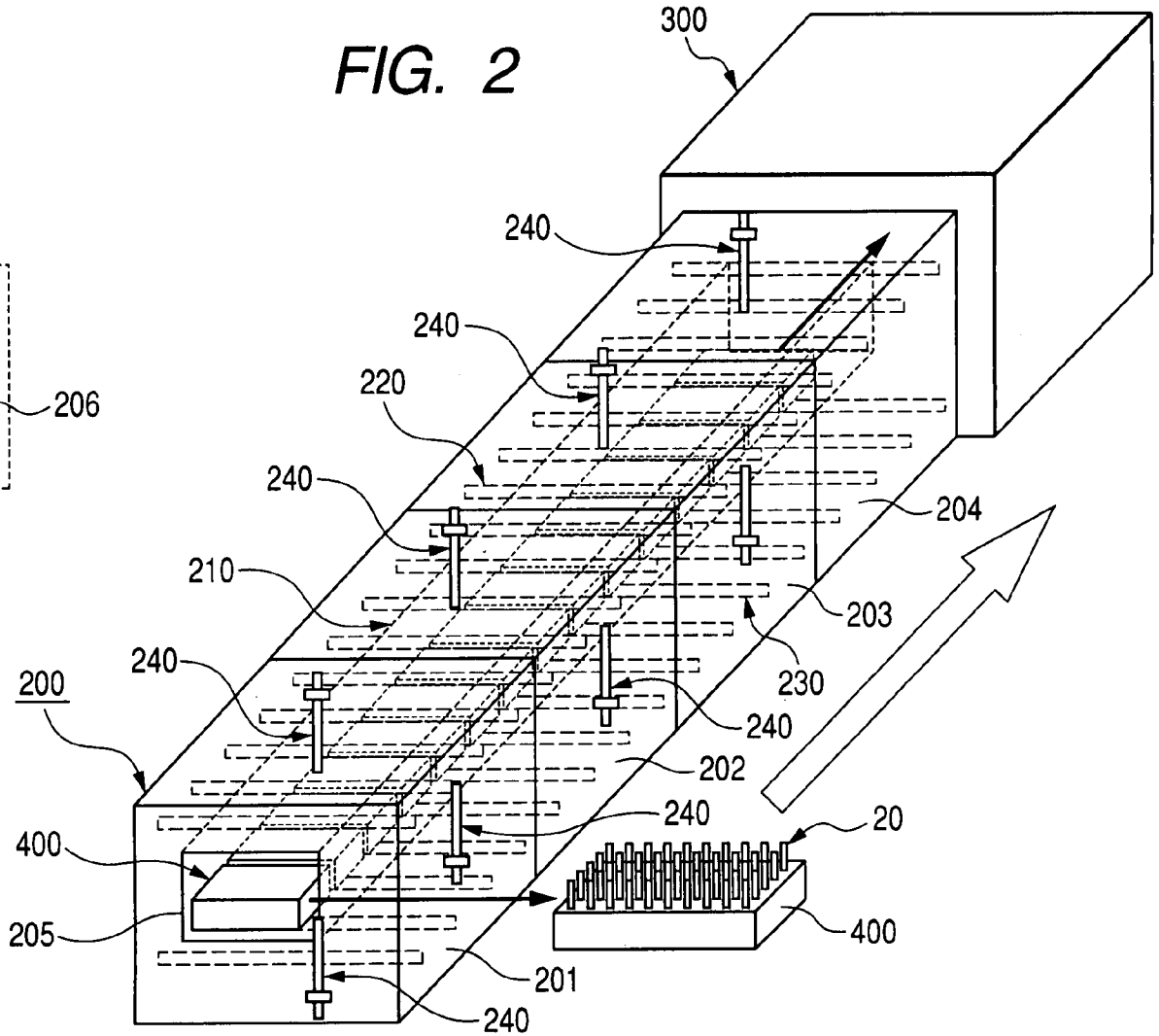
FIG. 2 is a perspective view showing the structure of a spark plug manufacturing apparatus according to an embodiment of the invention.

FIG. 2 is a perspective view showing the structure of the spark plug manufacturing apparatus. As shown in FIG. 2, this spark plug manufacturing apparatus is constituted by an electric furnace 200 and a hot-press unit 300.

The electric furnace 200 is for heating the insulators 20 and melting the glass materials of the first and second glass seal layers 51, 52 and the resistor 60 put in each of the insulators 20 by heating a holding plate (pallet) 400 on which a plurality of the insulators 20 are loaded. In this embodiment, the electric furnace 200 has sequentially disposed four heating zones 201 to 204 having different furnace temperatures. The heating zone 201 is provided with a pallet carry-in entrance through which the pallet 400 is carried into the electric furnace 200.

As shown in FIG. 2, the electric furnace 200 has a passage way 210, upper heaters 220, lower heaters 230, and thermometers 240. For controlling the operation of the electric furnace 200, any appropriate control device including electric and electronic circuits can be used. Accordingly, explanation for such a control device is omitted.

Figure 3:
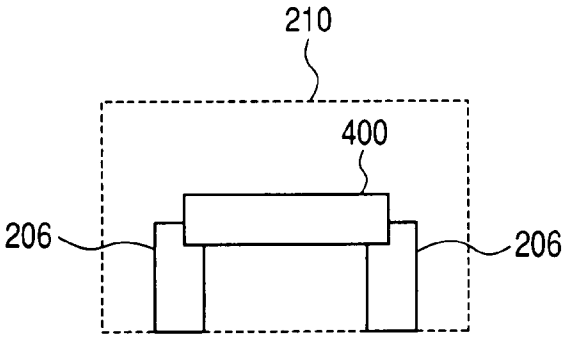
FIG. 3 is a diagram explaining how a pallet is supported by supporting members in an electric furnace of the spark plug manufacturing apparatus.

The pallet 400 carried into the electric furnace 200 through the entrance 205 is moved in the passage way 210. As shown in FIG. 3, supporting members 206 for supporting the pallet 400 are disposed in the passage way 210. The supporting members 206 are placed on the opposite sides of the direction in which the pallet 400 is moved to support the edge portions of the rear surface of the pallet 400.

The upper heaters 220 and the lower heaters 230 generate heat on the basis of electric signals received from an electric furnace heating circuit (not shown) such that the heating zones 201 to 204 are kept at different temperatures. The upper heaters 220 and the lower heaters 230 may be a Ni—Cr heater.

The thermometers 240 are disposed at both the upper side and the lower side of the passage way 210 to measure the temperatures of the heating zones 201 to 204. The thermometers 240 may be a thermocouple. The temperatures measured by the thermometers are supplied to the electric furnace heating circuit for the control of the upper and lower heaters 220, 230.

Figure 6:
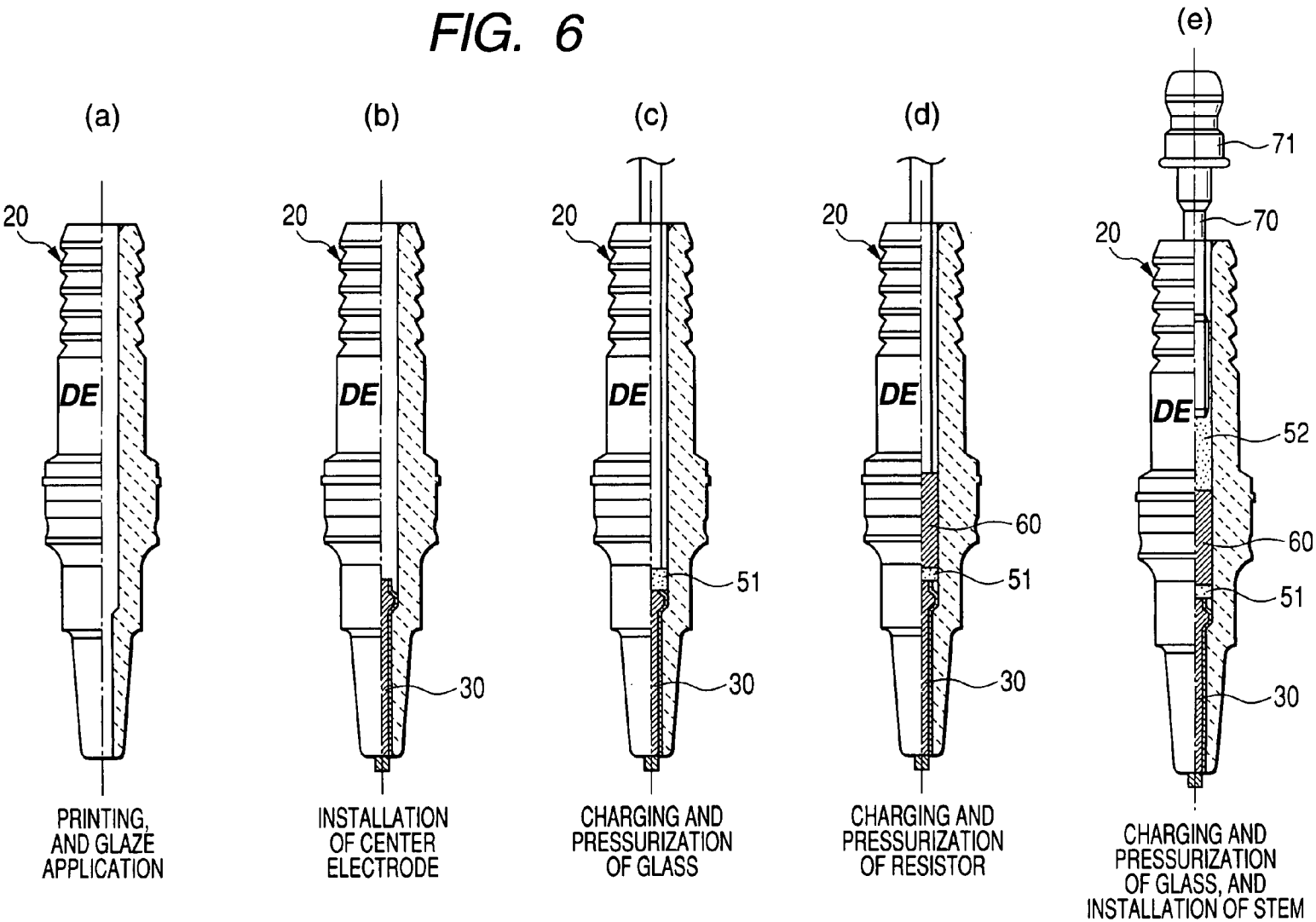
FIG. 6 is a diagram showing process steps for charging glass materials into the interior of an insulator of the spark plug.

The hot-press unit 300 is for pressing down the terminal parts 71 into the interiors of the insulators 20 in a process (e) in FIG. 6 (to be described later). More specifically, the insulators 20 heated in the electric furnace 300 are carried into the hot-press unit 300 where the terminal parts 71 inserted into the insulators 20 are pushed into the insulators 20. The hot-press unit 300 includes a pressing member 320 having protrusions 321 formed in such positions that they face the terminal parts 71 inserted into the insulators 20 (see FIG. 7 to be described later). The hot-press unit 300 is configured to press down the terminal parts 71 by a force larger than 300 N.

Figure 4:
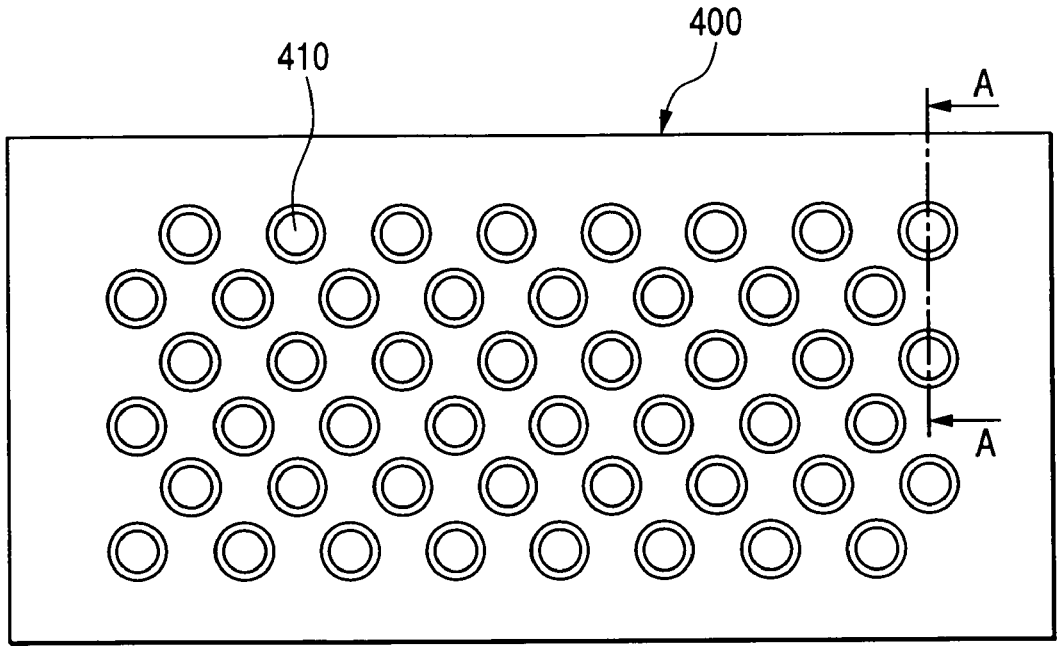
FIG. 4 is a plan view of the pallet.

Next, the structure of the pallet 400 is explained in detail below. FIG. 4 is a plan view of the pallet 400, and FIG. 5 is a cross-sectional view of the pallet 400 along a line A-A in FIG. 4.

In this embodiment, the pallet 400 has a shape of a rectangular plate and is formed with a plurality of mounting holes 410 extending in the direction of the thickness of the pallet 400. As shown in FIG. 4, these mounting holes 410 are arranged in a staggered fashion. More specifically, these mounting holes 410 are arranged such that they are on straight lines extending from left to right in FIG. 4, and on oblique lines extending from top to bottom in FIG. 4. The pallet 400 has 6 straight lines on which 8 mounting holes are formed. Accordingly, the pallet 400 can carry 48 insulators 20. By arranging the mounting holes 410 in a staggered fashion, it becomes possible to reduce a useless area on the surface of the pallet 400, to thereby increase the productivity.

Figure 5:
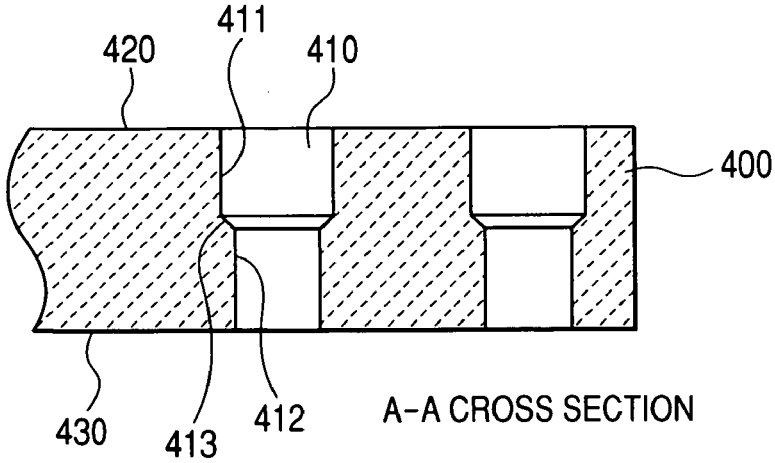
FIG. 5 is a cross-sectional view of the pallet along a line A-A in FIG. 4.

As shown in FIG. 5, each of the mounting holes 410, which penetrates from the front surface to the rear surface of the pallet 400, is constituted by two coaxial holes having different diameters. More specifically, the mounting hole 410 is constituted by a first hole 411 and a second hole 412 having a diameter smaller than that of the first hole 411. The diameter of the first hole 411 is about the same as the outer diameter of the barrel portion 21 of the insulator 20. The diameter of the second hole 412 is set at such a value that the portion from the front end to the barrel portion 21 of the insulator 20 can pass through the second hole 412.

The first hole 411 opens to the front surface 420 of the pallet 400, and the second hole 412 coaxial with the first hole 411 opens to the rear surface 430 of the pallet 400. Accordingly the mounting hole 410 has a step portion 413 defined by the diameter difference between the first hole 411 and the second hole 412. When the insulator 20 is set in the mounting hole 410, it is held by the pallet 400 in a state that the barrel portion 21 of the insulator 20 abuts against the step portion 413.

The thickness of the pallet 400 is set at such a value that the front end 20*a* of the insulator 20 projects from the rear surface 430 of the pallet 400 when it is set in the mounting hole 410. The pallet 400 has a bending strength of not less than 600 MPa when it is heated to 800 degrees C.

The pallet 400 is made of a ceramic material containing at least 50 wt % (more than 95 wt % in this embodiment) of silicon nitride ($Si_3N_4$) as a major component. The ceramic material contains, other than $Si_3N_4$, $MoSi_2$, $Al_2O_3$, CaO, $Y_2O_3$, MgO, and BN.

In this embodiment, the pallet 400 is formed by sintering a ceramic base material containing more than 95 wt % of silicon nitride at high temperature. The weight of such a pallet 400 is smaller than 2 kg/50 pieces of works (mounting holes), which is smaller than a half of that of the conventional pallet whose weight is more than 4 kg/50 pieces.

Next, explanation is made as to how the spark plug 100 is manufactured with particular emphasis on the processes for forming the glass elements (the first and second glass seal layers 51, 51, and the resistor 60) inside the insulator 20. FIG. 6 is a diagram showing process steps (a) to (e) for charging glass materials of the first and second glass seal layers 51, 51, and the resistor 60 into the interior of the insulator 20.

At the beginning, printing is made on a desired portion of the tubular hollow insulator 20, and then a glaze is applied to the surface of the insulator 20 in process step (a).

In process step (b), the center electrode 30 is mounted to the insulator 20. More specifically, the center electrode 30 is inserted into the axis hole 20 of the insulator 20. Next, a conductive glass powder is charged into the axis hole 20*c* of the insulator 20 as a material of the first glass seal layer 51 and pressurized in process step (c).

Subsequently, in process step (d), a resistance material (conductive glass) is charged into the axis hole 20*c* and pressurized on the conductive glass powder charged in process step (c). Thereafter, in process step (e), a conductive glass powder is charged into the axis hole 20*c* and pressurized on the resistance material charged in process step (d). Next, the stem 70 fitted with the terminal part 71 is inserted from the rear end 20*b* of the insulator 20.

After that, a plurality of the insulators 20 having been subjected to the process steps (a) to (e) are loaded on the pallet 400. The pallet 400 is carried into the electric furnace 200 from the entrance 205. The insulators 20 loaded on the pallet 400 are heated to set temperatures in the heating zones 201 to 204.

More specifically, a plurality of the pallets 400 on each of which a plurality of the insulator 20 are loaded are carried into the electric furnace 200 one by one. Each pallet 400 moves forward in the electric furnace 200 by being pushed by the succeeding pallet 400. In this embodiment, the pallets 400 are carried into the electric furnace one by one at intervals of 30 to 65 seconds. Each pallet 400 passes through all the heating zones 201 to 204 in 20 to 40 minutes.

The upper heaters 220 and the lower heaters 230 are controlled such that the temperature of the pallet 400 (insulators 20) rises in stages as the pallet 400 moves from the entrance 205 to the side of the hot-press unit 300. The glass materials charged into the insulators 20 melt while the pallet 400 heated in this way moves in the electric furnace 200.

Figure 7:
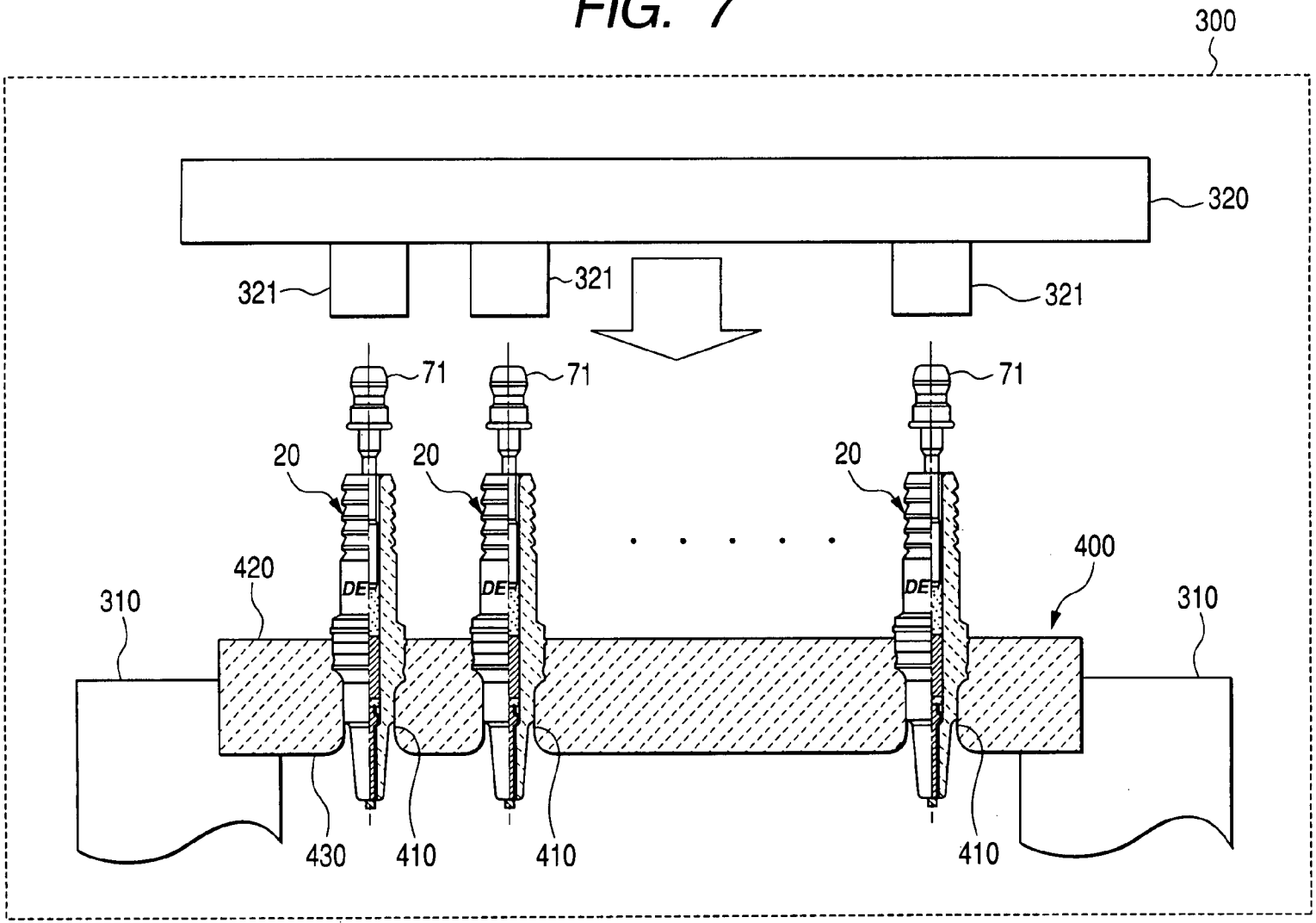
FIG. 7 is a diagram showing how terminal parts are pressed down into the insulator of the spark plug in a hot-press unit of the spark plug manufacturing apparatus.

The pallet 400 that has passed through the electric furnace 200 is carried into the hot-press unit 300, where the terminal parts 71 inserted into the insulators 20 are pressed downward as shown in FIG. 7. The hot-press unit 300 includes supporting members 310 for supporting the pallet 400, and a pressing member 320 for pressing the terminal parts 71.

The supporting members 310 hold the edge portions of the rear surface 430 of the pallet 400 like the supporting members 206 shown in FIG. 3. The pressing member 320 has protrusions 321 disposed in such positions that they face the terminal parts 71 of the insulators 20 fitted into the mounting holes 410 of the pallet 400.

The hot-press unit 300 performs a pressing process where the protrusions 321 of the pressing member 320 are moved in the direction of the arrow shown in FIG. 7 to press the terminal parts 71 into the interiors of the insulators 20 loaded on the pallet 400.

More specifically, the pallet 400 is moved to such a position that the pallet 400 is immediately below the pressing member 320 of the hot-press unit 300. At this time, since the insulators 20 loaded on the pallet 400 have been heated by the electric furnace 200, the conductive glasses and the resistor materials charged in the insulators 20 are in a molten state. Next, the protrusions 320 are moved to the side of the pallet 400, as a result of which the terminal parts 71 are pressed to the side of the pallet 400. In this embodiment, the terminal parts 71 are pressed with a force larger than 300 N.

After that, the protrusions 320 are pulled upward, and the pallet 400 are carried out of the hot-press unit 300 to be cooled down. In this way, the conductive glass and the resistance material charged into each insulator 20 are solidified to make the first and second glass seal layers 51, 52 and the resistor 60.

After that, each insulator 20 is fitted with the housing 10. Subsequently, the crimp portion 10*c* formed in the rear end 10*b* of the housing 10 is crimped and fixed to the insulator 20, and the ground electrode 40 is joined to the front end 10*a* of the housing 10 to complete the spark plug 100 shown in FIG. 1.

As already described above, the pallet 400 is made of the material containing silicon nitride. The inventor fabricated three other kinds of pallets, the conventional one made of heat-resisting steel, the one made of alumina, the one made of a material constituting chiefly of silicon carbide, and measured a specific gravity (g/cm$^3$), a specific heat×specific gravity (J/cm$^3$ K), a hot bending strength (MPa), a thermal shock temperature (degree C.), a thermal conductivity (W/m K), and a life (year) for each of the pallet of this embodiment and these three other kinds of the pallets. FIG. 8 is a table showing the measured results. The symbols "◎", "○", "Δ" and "X" in this table represent "excellent", "good", "moderate", and "bad", respectively.

As for specific gravity, the weight of the pallet can be made small when it has a small specific gravity. Accordingly, the silicon nitride and silicon carbide are in the category of ◎ since they have small specific gravities, while the heat-resisting steel is in the category of X since it has a large specific gravity, and alumina is in the category of ○.

As for specific heat×specific gravity, the amount of energy needed to heat the pallet can be made small if it has a small value of specific heat×specific gravity. Accordingly, the silicon nitride and silicon carbide are in the category of ◎ since their values of specific heat×specific gravity are small, while the heat-resisting steel is in the category of Δ since it has a relatively large value of specific gravity, and alumina is in the category of ○.

The hot bending strength is a value of a gradually increasing force being applied to a test piece heated to a certain temperature (800 degrees C., in this embodiment) when this test piece begins to deform. Accordingly, the silicon nitride is in the category of ◎ since it has a very high hot bending strength, while the others are in the category of Δ. Incidentally, the inventor has confirmed that the pallet 400 having the shape and thickness as shown in FIG. 7 is not broken when it is applied with a bending strength not lower than 600 MPa.

The thermal shock temperature is a heated temperature of a test piece at which the test piece can be broken when it is rapidly cooled down. Accordingly, the heat-resisting steel and the silicon nitride are in the category of ◎ since they have high thermal shock temperature, while the others are in the category of X.

The temperature variation of the pallet can be made small if it is made of a material having a high thermal conductivity. Accordingly, the silicon nitride and the silicon carbide are in the category of ◎ since they have high thermal conductivities, while the others are in the category of Δ. Incidentally, although the table of FIG. 8 shows that the thermal conductivity of the silicon nitride is in the range of 25 to 65 W/m·k, the inventor has found that the temperature uniformity of the pallet 400 is greatly improved if it has a thermal conductivity not smaller than 30 W/m·K.

The table of FIG. 8 shows that the pallet made of heat-resisting steel has a useful life time shorter than two years, and that the life times of the pallets made of alumina and silicon carbide are too short for use in the heating process of the spark plugs. On the other hand, the table shows that the pallet 400 made of silicon nitride, which is a ceramic material, has a useful life time longer than 10 years.

In summary, silicon nitride is the most suitable material for the pallet of all the measured materials in terms of the specific gravity, specific heat×specific gravity, hot bending strength, thermal shock temperature, thermal conductivity, and life.

In addition to the above, the inventor measured the temperatures of the interior of the insulator 20 located at the center portion B of the pallet and the interior of the insulator 20 located at the edge portion A of the pallet (see FIG. 9A) in order to check temperature uniformity for a case where the pallet is made of silicon nitride and for a case where the pallet is made of heat-resisting steel by use of thermocouples disposed inside these insulators 20.

FIG. 9B shows the difference of the measured temperatures for each of these two cases.

As seen from FIG. 9B, the temperature difference between the insulator 20 located at the center portion and the insulator 20 located at the edge portion is more than 80 degrees C./50 pieces in the case of the pallet made chiefly of heat-resisting steel. Such a large temperature difference causes large resistance difference between the resistors 60 of these insulators. On the other hand, the temperature difference between the insulator 20 located at the center portion and the insulator 20 located at the edge portion is less than 50 degrees C./50 pieces in the case of the pallet made chiefly of silicon nitride.

As explained above, the pallet 400 of this embodiment is light in weight and has high durability to heat, because it is made of the ceramic material containing at least 50 wt % of silicon nitride, preferably more than 95% wt of silicon nitride. Furthermore, the pallet 400 of this embodiment can be used semipermanently, because the pallet made of this ceramic material exhibits very little thermal deformation.

In addition, the pallet 400 has such a small thickness that the rear end 20*b* and the front end 20*a* of the insulator 20 respectively project from the front surface 420 and the rear surface 430 of the pallet 400. Therefore, the volume and accordingly the weight of the pallet 400 can be made small. This reduces the amount of energy needed to heat the pallet 400 to a desired temperature. Also, the time needed to heat the insulator 20 to a desired temperature can be shortened since both the rear and front ends 20*b*, 20*a* of the insulator 20 are exposed from the pallet 400.

In addition, in this embodiment, the hearth 600 as shown in FIG. 10 can be eliminated, because the pallet 400 is supported by the supporting members 206 as shown in FIG. 3. The elimination of the hearth 600 improves the heating efficiency of the lower heaters 230 heating the rear surface 430 side of the pallet 400. The inventor has found through experiment that removing the hearth 600 increases the heating efficiency by 45%.

Furthermore, in this embodiment, the temperature non-uniformity of the pallet 400 is small, because the thermal conductivity of the pallet 400 is larger than 30 W/m·K, and accordingly the heat applied by the heaters is distributed throughout the pallet 400 in a short time. Accordingly, the resistance variation of the resistors 60 formed in the insulators 20 can be reduced.

Also, as explained above, the pallet 400 exhibits high durability to the cycles of heating and cooling, because the thermal shock temperature is as high as 850 degrees C.

It is a matter of course that various modifications can be made to the structures of the spark plug 100, electric furnace 200, and hot-press unit 300 as described below.

The pallet 400 may have such a thickness that the front end 20*a* of the insulator 20 does not expose at the rear surface 430 of the pallet 400 as shown in FIG. 10.

Although the mounting holes are arranged in a staggered fashion, they may be arranged in a different fashion.

The above explained preferred embodiments are exemplary of the invention of the present application which is described solely by the claims appended below. It should be understood that modifications of the preferred embodiments may be made as would occur to one of skill in the art.

What is claimed is:

1. A spark plug manufacturing apparatus comprising:

a holding plate formed with a plurality of mounting holes penetrating from a front surface to a rear surface thereof for holding therein hollow tubular insulators of spark plugs, each of which is fitted therein with a center electrode and a metal stem provided with a terminal part, and is charged with a powder resistance material between said center electrode and said stem; and an electric furnace for heating said insulators held in said mounting holes of said holding plate;

wherein said holding plate is made of a ceramic material containing not less than 50 wt % of silicon nitride.

2. The spark plug manufacturing apparatus according to claim 1, wherein said holding plate has such a thickness that one end of said center electrode and one end of said stem of said insulator held in said mounting hole projects from said rear surface and said front surface of said pallet, respectively, and has a bending strength not less than 600 MPa when heated to 800 degrees C.

3. The spark plug manufacturing apparatus according to claim 1, wherein said holding plate has a thermal conductivity not less than 30 W/m·K.

4. The spark plug manufacturing apparatus according to claim 1, wherein said mounting holes are arranged in a staggered fashion.

5. A method of manufacturing spark plugs comprising the steps of:

fitting a center electrode and a metal stem provided with a terminal part into a hollow portion of each of a plurality of hollow tubular insulator in a state that a powder resistance material is charged between said center electrode and said stem;

loading said plurality of said insulators fitted with said center electrode and said stem and charged with said powder resistance material on a holding plate in such a state that said insulators are held in mounting holes formed in said holding plate; and heating said insulators loaded on said holding plate in an electric furnace;

wherein said holding plate is made of a ceramic material containing not less than 50 wt % of silicon nitride.

6. The method according to claim 5 further comprising the steps of fitting a housing to each of said plurality of said insulators which have undergone said heating step, and joining a ground electrode to said housing such that said ground electrode faces an end of said center electrode to form a spark gap.

7. The method according to claim 5, wherein said holding plate has such a thickness that one end of said center electrode and one end of said stem of said insulator held in said mounting hole projects from a rear surface and a front surface of said pallet, respectively, and has a bending strength not less than 600 MPa when heated to 800 degrees C.

8. The method according to claim 5, wherein said holding plate has a thermal conductivity not less than 30 W/m·K.

9. The method according to claim 5, wherein said mounting holes are arranged in a staggered fashion.

* * * * *